United States Patent [19]

Suits

[11] Patent Number: 4,603,444

[45] Date of Patent: Aug. 5, 1986

[54] CONVERTIBLE FURNITURE APPARATUS

[76] Inventor: Bevan D. Suits, 2200 S. Aldrich, Minneapolis, Minn. 55405

[21] Appl. No.: 660,731

[22] Filed: Oct. 15, 1984

[51] Int. Cl.[4] ..... A47C 20/00

[52] U.S. Cl. ..... 5/431; 5/443; 5/465; 297/440; 297/456

[58] Field of Search ..... 5/465, 12 R, 443, 431, 5/432, 433, 455, 437; 297/440, 455, 456, 118, 284

[56] References Cited

U.S. PATENT DOCUMENTS

| | | | |
|---|---|---|---|
| D. 261,952 | 11/1981 | Valdez | D6/37 |
| D. 265,610 | 8/1982 | Gusrud | D6/64 |
| 321,230 | 6/1885 | Lewis | 297/118 |
| 2,623,574 | 12/1952 | Damsch | 297/118 |
| 3,379,472 | 4/1968 | Hilfiker | 297/118 |
| 3,663,055 | 5/1972 | Gale | 297/284 |
| 3,672,720 | 6/1972 | Wilson | 297/118 |
| 3,984,886 | 10/1976 | Keeton | 297/284 |
| 4,418,521 | 4/1979 | Van Hook | 297/118 |

FOREIGN PATENT DOCUMENTS

| | | | |
|---|---|---|---|
| 3114892 | 2/1982 | Fed. Rep. of Germany | 5/455 |
| 3308336 | 9/1984 | Fed. Rep. of Germany | 5/465 |

OTHER PUBLICATIONS

B-O-M-C Inc., Catalog S & S, 1981, p. 8.

Craft Furniture Fashion, (one sheet), "4218-24 Chair", (1973).

*Primary Examiner*—Alexander Grosz

*Attorney, Agent, or Firm*—Vidas & Arrett

[57] ABSTRACT

As article of manufacture a furniture apparatus convertible into a number of reclining and sitting positions.

6 Claims, 10 Drawing Figures

CONVERTIBLE FURNITURE APPARATUS

BACKGROUND OF THE INVENTION

This invention relates to a convertible piece of furniture for sitting or lying on or otherwise supporting a person or persons.

The article of manufacture provided by the invention is of such a design that it can be converted into a number of reclining and sitting positions or other supporting positions and can be easily disassembled for storage.

SUMMARY OF THE INVENTION

The convertible furniture article provided by the invention consists of a plurality of identical elements including bolster elements, spindles and links with overlapping ends. The spindles protrude through the bolsters. The links join adjacent spindles in overlapping relationship to provide a surface for sitting, reclining and so forth, the shape of which can be changed by changing the relative positions of the bolster elements. The size of the article can be readily changed by adding or removing bolsters.

PREFERRED EMBODIMENT

Figure 1:
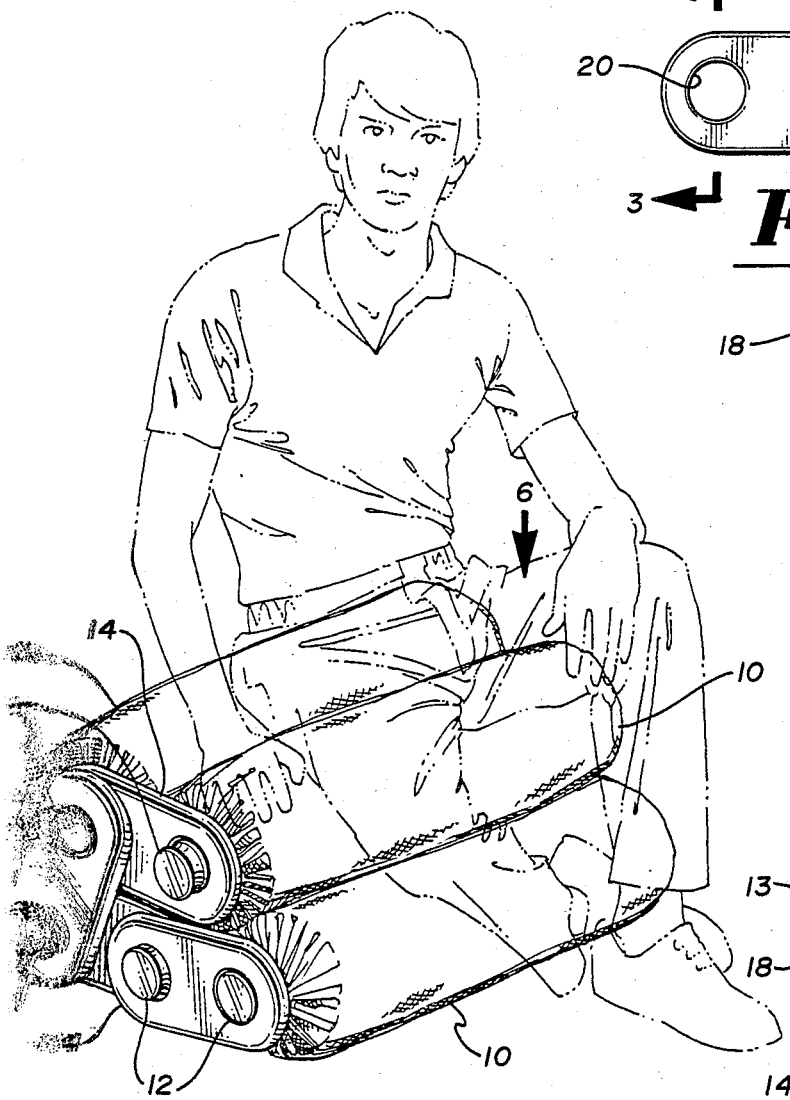
FIG. 1 is a perspective view of the invention with a human figure shown in phantom to illustrate one use of the invention.
Figure 7:
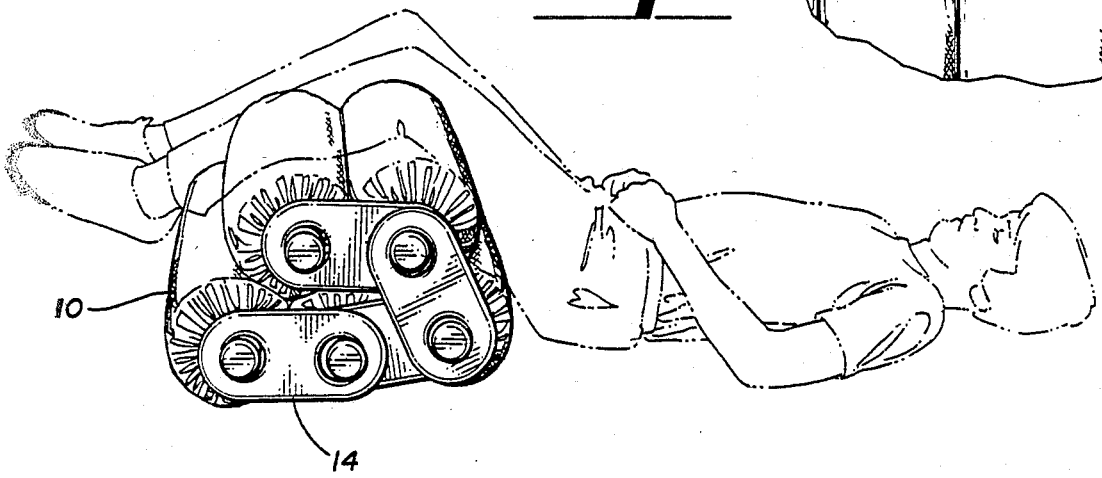
FIG. 7 is a perspective view of the invention shown in optional use.
Figure 8:
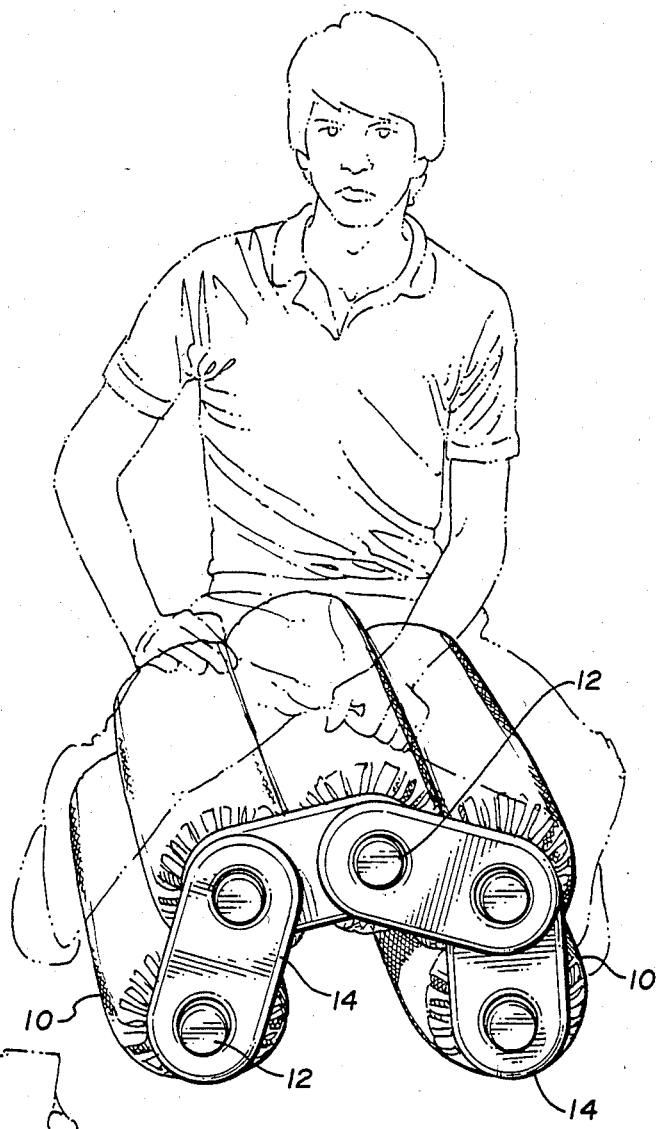
FIG. 8 is a perspective view of the invention showing a further optional use.
Figure 9:
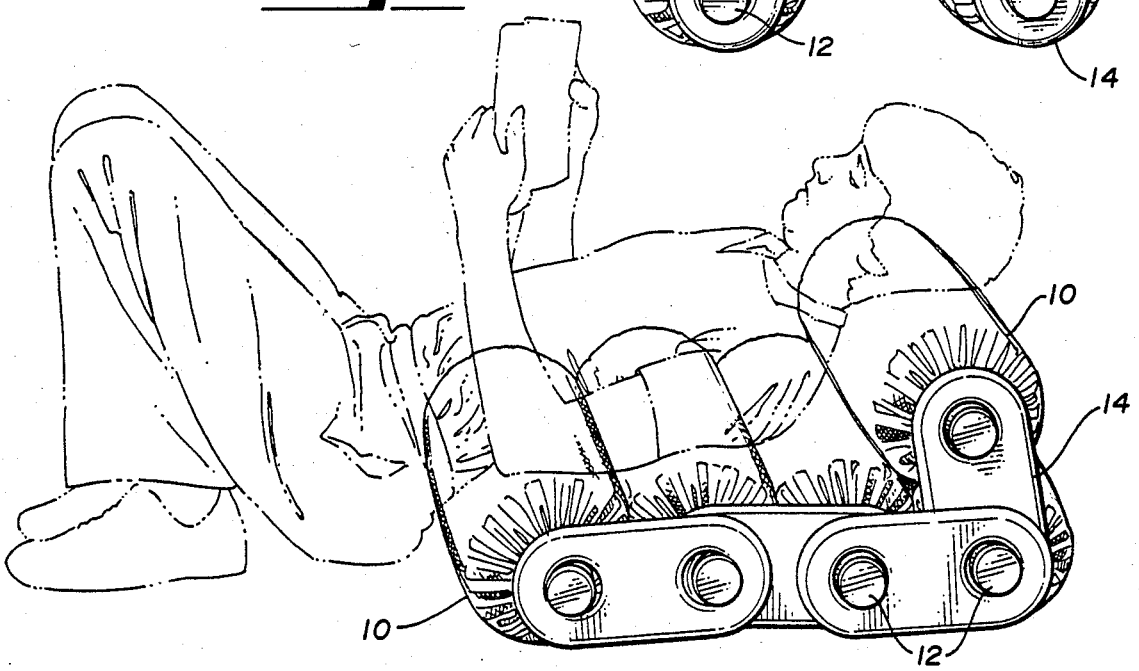
FIG. 9 is a perspective view of the invention showing a still further optional use.

The article of manufacture provided by this invention consists of a convertible furniture article which can be arranged in a number of reclining and sitting positions. The article consists of three basic elements which can be combined in number: bolster elements 10, spindle element 12 and link elements 14 as shown in FIG. 1. FIG. 1 also shows how, in one use, the bolster elements can be relatively positioned to provide an article adapted for sitting or as in FIG. 7 for reclining. FIGS. 8 and 9 respectively show other relative positions of the bolster elements for sitting and reclining usage.

Figure 3:
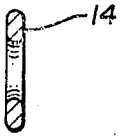
FIG. 3 is a section of the link element taken along line 3—3 of FIG. 2.
Figure 4:
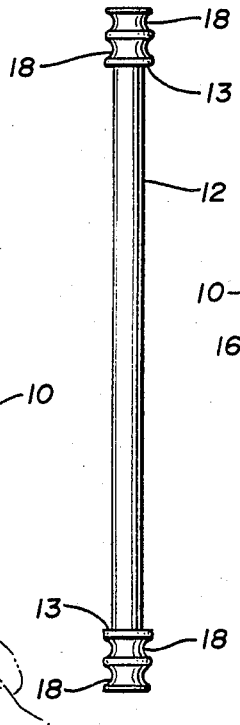
FIG. 4 is an elevational profile view of one spindle element.
Figure 5:
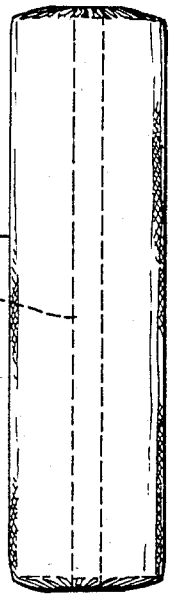
FIG. 5 is an elevational profile view of one bolster element.
Figure 6:
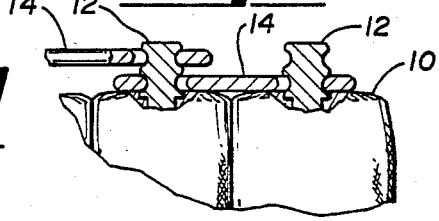
FIG. 6 is a partial top plan detail of the invention taken in the direction of arrow 6 in FIG. 1 with parts cut away.

The basic elements of the article are shown in FIGS. 2–5. FIG. 5 shows the bolster element 10 which is preferably formed of a foam elastomer such as polyurethane foam although any other suitable cushioning material which is resilient may be utilized. The bolster may even be formed of a container material containing a liquid similar to the structure and materials utilized in making water beds. The preferred foam bolster will also preferably be covered with a decorative covering material as is typical in the furniture art (not shown). Bolster 10 defines a longitudinal passage 16 which extends therethrough and in the preferred cylindrical form of the bolster will be centered therein.

Passage 16 is intended for receiving spindle 12 therethrough for linking a plurality of bolster elements together as is shown in the other figures.

FIG. 4 shows a preferred form of spindle 12 which includes a pair of annular grooves 18 at each end thereof. An alternate end portion design of spindle 12 is shown in FIG. 4*a*.

Figure 2:
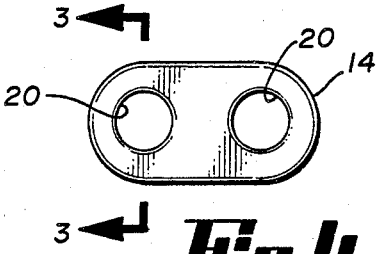
FIG. 2 is a side elevational view of one link element.

FIGS. 2 and 3 show link members 14 which in their preferred form contain a pair of spaced apertures 20. Apertures 20 are spaced relative to each other such that when they are fitted in overlapping relationship on adjacent grooves 18 of spindles 12 as shown in FIGS. 1, 6, 7, 8 and 9 that they draw the spindles together thereby compressing the resilient material of bolster 10 to generate a force which tends to push adjacent spindles 12 apart thus locking links 14 in annular grooves 18 securely. The overlapping arrangement of the links is shown in detail in FIG. 6.

The unique features of the article provided by this invention includes several obvious aspects thereof. The separability of the various elements permits shipment in a knock-down condition while permitting assembly without the aid or necessity of tools and complicated assembly instructions. The spindles and links, through their unique connection system involving the resiliency of the bolsters, provides the utmost simplicity in joining the various pieces of the article together. The coaction of the assembled elements due to their simplicity of design and function allows for the ready convertibility of their relative positions to various arrangements for a wide number of optional uses. Additionally, elements can be readily added or removed to change the size of the article. Also, the article of this invention may be readily combined with other furniture pieces for a wide variety of uses.

Figure 4A:
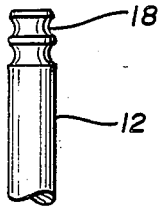
FIG. 4*a* is a view of an end of an alternative spindle element.

The difference between the spindle of FIG. 4 and the spindle of FIG. 4*a* lies in the shoulder 13 provided in the embodiment of FIG. 4. This shoulder may be effectively used to aid in maintaining the position of bolster 10 on spindle 12. However, it is not necessary, as can be seen in FIG. 4*a* wherein shoulder 13 is not included.

The preferred embodiment of the apparatus of the invention has been illustrated and described hereinabove. However, it is to be understood that the invention is susceptible of many modifications which will fall within the spirit and scope of the appended claims.

What is claimed is:

1. An article of manufacture convertible into a number of reclining and sitting positions, comprising:

a plurality of parallel resilient cushioning bolster elements defining an occupant supporting area;

a corresponding plurality of spindles, each of which extends longitudinally through a respective bolster element and wherein the end of each spindle defines a pair of adjacent annular grooves for respectively receiving adjacent links, and a plurality of links apertured to fit over the spindle ends with overlapping ends extending between the ends of adjacent spindles and rotatably joining the spindles and bolster elements to each other in any one of a number of selectable relative positions for reclining and sitting, the links being constructed and arranged to interconnect the ends of the spindles such that the resilient bolsters are compressed against each other whereby they exert force tending to maintain the elements in assembly.

2. The article of claim 1 wherein each bolster element defines a longitudinal spindle-receiving passage.

3. An article of manufacture convertible into a number of reclining and sitting positions, comprising:

a plurality of parallel resilient cushioning bolster elements defining an occupant supporting area;

a corresponding plurality of spindles, each of which extends longitudinally through a respective bolster element, the end of each spindle defining a pair of adjacent annular grooves for respectively receiving adjacent links, the links being apertured to fit over the spindle ends, and a plurality of links with overlapping ends extending between the ends of adjacent spindles and rotatably joining the spindles and bolster elements to each other in any one of a number of selectable relative positions for reclining and sitting, the links defining a pair of spaced apertures for respectively fitting over the ends of adjacent spindles, the apertures being spaced such that adjacent spindles are drawn together to squeeze the bolster elements together whereby their resiliency exerts a force tending to push the spindles apart thus securing the links in the grooves.

4. The article of claim 3 wherein the bolster elements are cylindrical.

5. The article of claim 3 wherein the apertures are holes contained wholly within the link body.

6. The article of claim 5 wherein the holes are circular as are the spindle grooves.

* * * * *